US005902168A

United States Patent [19]

Poulsen et al.

[11] Patent Number: 5,902,168

[45] **Date of Patent: *May 11, 1999**

[54] COUPLING ELEMENT FOR A CONSTRUCTIONAL BUILDING SET

[75] Inventors: Ole Vestergaard Poulsen; Jan Hatting, both of Vejle, Denmark

[73] Assignee: INTERLEGO AG, Baar, Switzerland

[ * ] Notice: This patent issued on a continued prosecution application filed under 37 CFR 1.53(d), and is subject to the twenty year patent term provisions of 35 U.S.C. 154(a)(2).

[21] Appl. No.: 08/809,495

[22] PCT Filed: Sep. 28, 1995

[86] PCT No.: PCT/DK95/00392

§ 371 Date: May 5, 1997

§ 102(e) Date: May 5, 1997

[87] PCT Pub. No.: WO96/09868

PCT Pub. Date: Apr. 4, 1996

[30] Foreign Application Priority Data

Sep. 29, 1994 [DK] Denmark ..... 1125/94

[51] Int. Cl.[6] ..... A63H 33/10

[52] U.S. Cl. ..... 446/122; 403/294; 403/305; 446/113

[58] Field of Search ..... 446/104, 109, 446/111, 113, 120, 122; 403/294, 292, 305, 300

[56] References Cited

U.S. PATENT DOCUMENTS

| | | | |
|---|---|---|---|
| 432,626 | 7/1890 | Killinger | 403/292 |
| 1,012,063 | 12/1911 | Davis | 403/292 |
| 2,658,776 | 11/1953 | Wilcox | 403/300 |
| 2,683,329 | 7/1954 | Kobler | 446/122 |
| 3,590,516 | 7/1971 | Dunn | 446/120 |
| 4,278,836 | 7/1981 | Bingham | 403/294 |

FOREIGN PATENT DOCUMENTS

| | | | |
|---|---|---|---|
| 21960 | 1/1981 | European Pat. Off. | 47/44 |
| 369579 | 9/1974 | Sweden . | |
| 515046 | 12/1971 | Switzerland . | |
| 167380B1 | 10/1993 | United Kingdom . | |

*Primary Examiner*—Robert A. Hafer
*Assistant Examiner*—Laura Fossum
*Attorney, Agent, or Firm*—Kane,Dalsimer,Sullivan,Kurucz, Levy, Eisele and Richard, LLP

[57] ABSTRACT

A coupling element for releasable retention of an end of an elongate pull element has a cavity to receive said end. The pull element is formed with a constriction and the coupling element with a corresponding cavity. The pull element may be inserted unobstructedly and subsequently be locked by moving a movable portion, e.g. in the form of a hinged portion, into a locking position in which, in combination with the cavity, it establishes releasable locking of the pull element.

8 Claims, 2 Drawing Sheets

COUPLING ELEMENT FOR A CONSTRUCTIONAL BUILDING SET

The invention concerns coupling elements for elongate pull elements and is of the type defined in the introductory portion of claim 1. The invention moreover concerns the use of such a coupling element as a terminating element and a connecting element, respectively, it being possible to secure an elongate pull element by means of the coupling element to other elements in the constructional building set or to other pull elements.

The type of building elements forming the subject-matter of the invention is used in constructional building sets of a more complex nature. An example of such a building set is the one marketed under the trademark LEGO TECHNICT™. EP-A-560 851 discloses such a coupling element Which receives elongate, flexible pull elements between opposed, resilient Walls of the coupling element. The actual mounting of the pull element takes place by moving it laterally into a keyhole-shaped cavity in Which snap-locking is established when the pull element has passed two projections in parallel with its longitudinal direction. However, a relatively great moment is required to pass these projections, and this is not expedient since the parts involved are relatively small and resilient.

The corresponding principle is known from U.S. Pat. No. 5,061,219, the flexible pull elements being here replaced by rigid, rod-shaped members.

The object of the invention is to provide a coupling element of the type mentioned above, where the coupling element can be coupled with flexible, elongate pull elements, Without it being necessary to subject the pull elements to a great moment in the transverse direction in order to establish coupling.

This object is achieved in that the coupling element is constructed as defined in the characterizing portion of claim 1, an end of the pull element being placed in the cavity in the coupling element, following which locking takes place in that a movable portion is moved to a closed position in which it contributes to retaining the pull element.

The movable portion may advantageously be constructed as a hinged portion having a hinge axis in parallel wraith the longitudinal axis of the pull element, since loads on the portion caused by pulls in the pull element can be distributed evenly. The coupling element is expediently made integral with the hinged portion by plastics injection moulding, since the costs of manufacturing the element are hereby reduced. The hinged portion may then advantageously be formed with snap-locking means, so that, in its closed position, it is secured to the coupling element through the snap-locking means in its one side and by the hinge axis in its other side.

As stated in claim 5, the projection may advantageously be provided on the movable portion in a U-shaped channel, since the introduction of the pull element into the cavity thus takes place completely without resistance, the pull element being merely inserted until the end face abuts the bottom wall of the cavity. Then the U-shaped channel on the movable portion guides the pull element into position during closing, and retains it subsequently when closing has been completed. This structure is particulary expedient if the pull element is introduced axially through an opening in the end of the coupling element, said opening being formed in that a bridge portion is provided in tension of the movable portion, said bridge portion serving as a support portion for the movable portion.

The coupling element is used particularly expediently as a terminating element for a pull element, it being provided with coupling means, in addition to the cavity with the hinged portion in its other end, for coupling with other building elements incorporated in the toy building set. These coupling means may e.g. be a cylindrical bushing having guide beads to receive a ball head, or merely a bushing to receive a cross-shaft or cross stub shaft. Further, the coupling element may be used as a connecting element between e.g. two pull elements, so that two pull elements can replace one longer pull element upon coupling. However, nothing prevents the coupling element from being incorporated in a hub structure where it forms the basis for a plurality of radially protruding pull elements.

The invention will be explained more fully below in connection with preferred embodiments and with reference to the drawing, in which.

Figure 1:
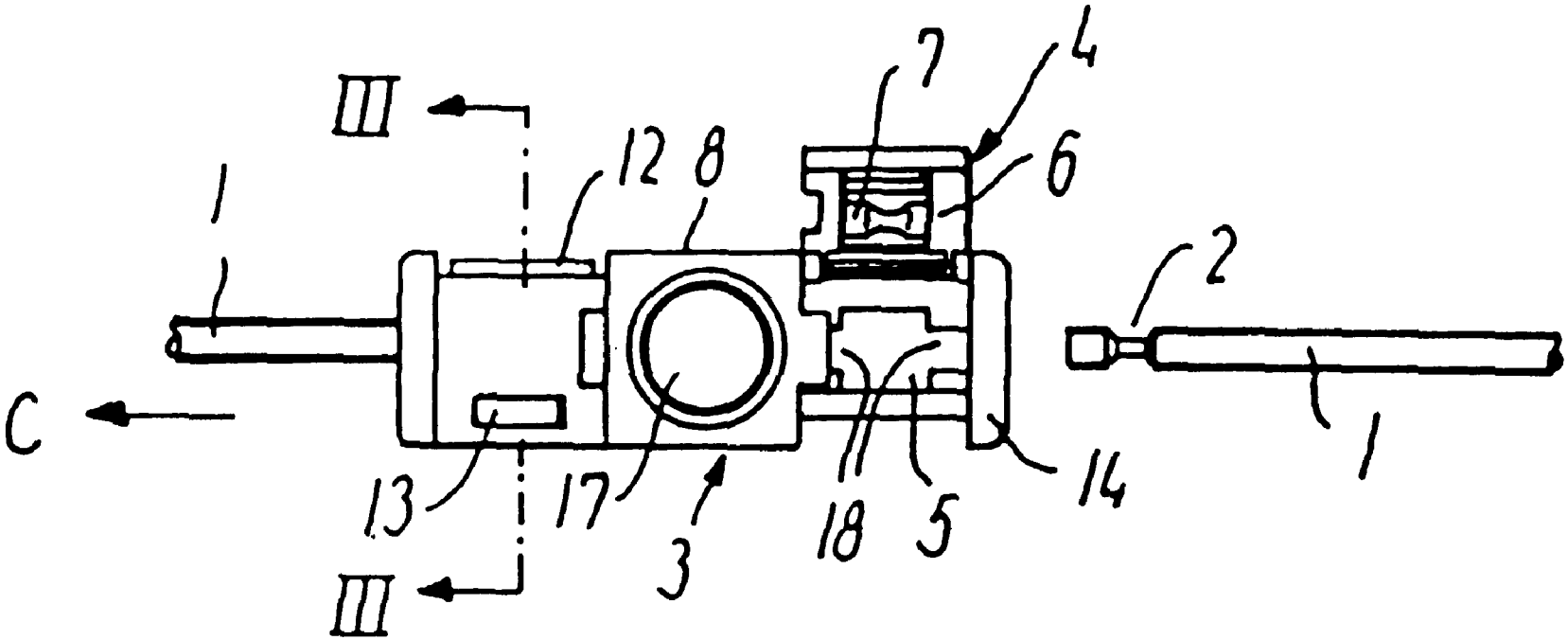
FIG. 1 is a plan view of an embodiment of a coupling element according to the invention used as a connecting element.

FIG. 1 shows a cull element 1 having an annular constriction near its one end. The cull element 1 as such is known per se in connection with constructional building sets and is marketed in such a set designated LEGO TECHNICT™. A coupling element 3 is formed with a cavity 5 to receive and secure one end of the pull element. The coupling element 3 is formed with a hinged portion 4 which is provided with an insert 6 having a U-shaped channel to surround the end of the pull element 1 upon closing of the hinged portion 4, for which reason the U-shaped of the insert 6 is formed with an annular projection 7 which cooperates with the constriction 2 on the pull element 1.

Figure 2:
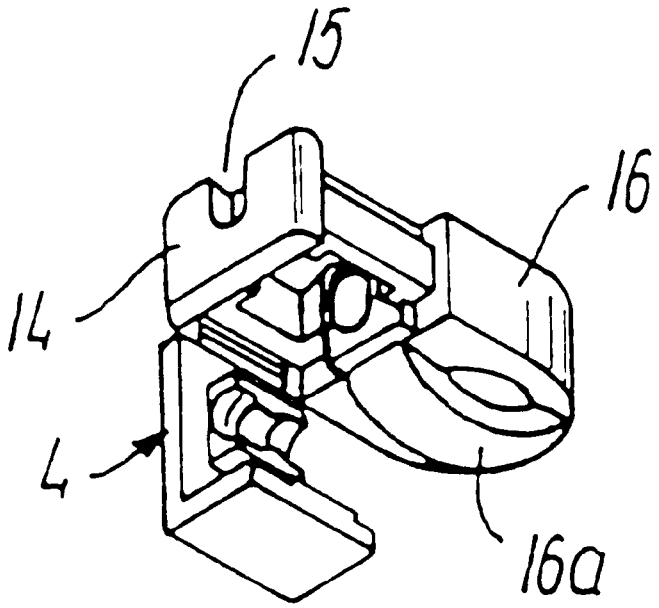
FIG. 2 is a perspective view of another embodiment of a coupling element according to the invention.

The pull element 1 is coupled to the coupling element 3 by moving the end of the pull element 1 through an opening corresponding to the opening 15, which is shown in FIG. 2, and which has an inside diameter corresponding to the cross-section of the pull element 1. During the insertion of the pull element 1, the channels 18 in each end of the cavity 5 serve as guides for the pull element 1. When the pull element 1 is in position, the hinged portion 6 is tipped around its hinge axis, whereby the insert 6 contacts the pull element 1 to secure the pull element until the hinged portion is again turned to its open position.

Figure 3:
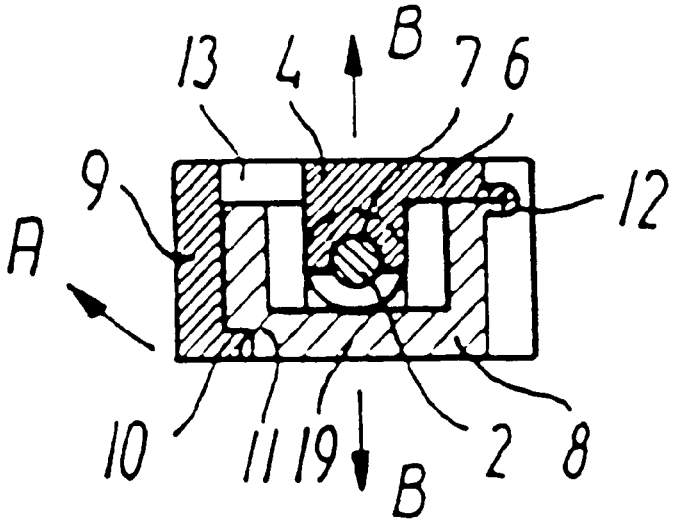
FIG. 3 is a sectional view of the locking principle of the embodiment shown in FIG. 1 along the line III-III.

With reference to FIG. 3 it will be seen that the hinged portion 4 and the main body 8 of the coupling element 3 are integral, said part being connected through a film hinge or an integral hinge 12. The hinged portion 4 is L-shaped and is maintained in a closed position by means of an one of the branches 9, of the L which is formed with snap-locking means 10 that engage complementary snap-locking means on the main body 8 in the locking position. It will moreover be seen that the branch 9 is made additionally flexible by means of a recess 13, so that even a very small force on the angled wall portion 9 in the direction of the arrow A causes the locking means 10, 11 to be disengaged, and enables the hinged portion 4 to be disengaged from the pull element 1.

FIG. 1 shows that the coupling element is formed with a bridge connection which engages the hinged portion 4 in its locking position, so that it relieves the pull acting on the hinge 12 and the snap-locking means 10 of the hinged portion.

A skilled person will moreover appreciate that the constriction 2 and the projection 7 are selected with suitably tapering engagement faces, so that a pull in the direction indicated by the arrow C on the pull element 1 causes the hinged portion 4 and the bottom wall 19 on the main body 8 of the coupling element to move away from each other in the direction indicated by the arrows B, whereby the resilient walls of the coupling element prevent the parts from being destroyed by a too great pull. The parts will merely be separated without being subjected to permanent damage.

It will be seen that the coupling element shown in FIG. 1 is formed as a connecting element, since it connects the ends of two adjacent pull elements. To increase the usefulness of the connecting element, it is moreover formed with coupling means 17 for coupling with other elements incorporated in the toy building set, and here it is a through hole with snap-locking beads for cooperation with a bushing, a cross-shaft or a cross stub shaft.

Correspondingly, the coupling element shown in FIG. 2 is formed as a terminating element, it being formed With coupling means 16 for coupling with other components in the toy building set. Thus, the pull element is terminated to e.g. a ball head which can be received and retained in the coupling means 16 is in the form, of a bushing having internal locking beads or locking projections, and a bridge 16*a* which forms a bottom bearing for the ball head.

It may also be said that the coupling element shown in FIG. 1 constitutes a combined terminating and connecting element since it may serve both purposes.

It is clear that the insert 6 With the U-shaped channel with an internal projection 7 can be formed in the bottom of the cavity 5, the pull element 1 being moved into the U-shaped channel by a lateral movement, which does not apply any considerable moment load, because the retention is subsequently established by means of the hinged portion.

It is likewise clear that the film hinge may be provided attached to the bridge connection 14, and the hinge axis of the hinged portion 4 will then just extend transversely to the longitudinal direction of the pull element 1.

Other embodiments are also conceivable in which the movable portion is slidable with respect to the main body of the coupling element, and where the pull element is received between two resilient walls on the main body, the resiliency of the walls being subsequently prevented by displacing the locking portion.

What is claimed is:

1. A coupling mechanism for use in a toy building set, the coupling mechanism comprising:

a coupling element in combination with an elongate pull element;

the pull element having a longitudinal axis and a constriction defining an end flange on the pull element;

the coupling element having two parts interconnected by a hinge such that said two parts can pivot relative to each other between an open position and a closed position and at least one coupling means for coupling with other elements of the toy building set;

the two parts in their closed position defining a cavity therebetween adapted to accommodate an end portion including the constriction of the pull element, the cavity being formed with a projection for engagement with the constriction such as to retain the pull element in the cavity:

the coupling means having a center situated on the longitudinal axis of the pull element.

2. A coupling mechanism according to claim 1, characterized in that the two coupling element parts are hinged via a hinge axis substantially parallel with the longitudinal axis of the pull element when the coupling element and the pull element are engaged.

3. A coupling mechanism according to claim 2, characterized in that the two coupling element parts are made integral with each other by plastics injection molding.

4. A coupling mechanism according to claim 2, characterized in that one of said two coupling element parts has a snap-locking means (10) in a side facing away from the hinge axis (12), and that the snap-locking means (10) cooperates with a complementary snap-locking means (11) on the other part of the coupling element.

5. A coupling mechanism according to claim 1, characterized in that the projection (7) is provided on one of said two coupling element parts in a U-shaped channel (6) extending in direction a direction parallel to the longitudinal axis of the pull element when the connecting element and the pull element are engaged.

6. A coupling mechanism according to claim 5, characterized in that the cavity (5) is formed with a bridge portion (14) in an inlet end of the coupling element, said bridge portion (14) forming an opening for the pull element (1), said opening having an internal diameter corresponding to the cross-section of the pull element.

7. A coupling mechanism according to claim 1 wherein said coupling element has locking means for securing said two parts in said closed position.

8. A coupling mechanism according to claim 1 wherein said coupling element has one or more additional cavities to receive additional pull elements so that said coupling element can serve as a connecting element.

* * * * *